United States Patent [19]

Colegrove et al.

[11] Patent Number: 4,592,760

[45] Date of Patent: Jun. 3, 1986

[54] COAL SLURRY

[75] Inventors: George T. Colegrove, San Diego; Thomas A. Lindroth, Spring Valley, both of Calif.

[73] Assignee: Merck & Co., Inc., Rahway, N.J.

[21] Appl. No.: 692,952

[22] Filed: Jan. 22, 1985

[51] Int. Cl.[4] ..... C10L 1/32

[52] U.S. Cl. ..... 44/51; 252/352; 536/1.1; 536/119; 536/123; 435/101

[58] Field of Search ..... 44/51; 252/352; 536/1, 536/119

[56] References Cited

U.S. PATENT DOCUMENTS

| | | | |
|---|---|---|---|
| 3,960,832 | 6/1976 | Kang et al. | 252/352 |
| 4,146,705 | 3/1979 | Knutson | 252/352 |
| 4,242,098 | 12/1980 | Brown et al. | 44/51 |
| 4,304,906 | 12/1981 | Kang et al. | 252/352 |
| 4,326,052 | 4/1982 | Kang et al. | 252/352 |
| 4,330,301 | 5/1982 | Yamamura et al. | 44/51 |
| 4,342,866 | 8/1982 | Kang et al. | 536/119 |
| 4,358,293 | 11/1982 | Mark | 44/51 |
| 4,401,760 | 8/1983 | Peik et al. | 435/101 |
| 4,415,338 | 11/1983 | Schick et al. | 44/51 |
| 4,441,887 | 4/1984 | Funk | 44/51 |
| 4,441,889 | 4/1984 | Mark | 44/71 |

FOREIGN PATENT DOCUMENTS

| | | |
|---|---|---|
| WO83/00500 | 2/1983 | PCT Int'l Appl. . |
| 2099451 | 12/1982 | United Kingdom . |

OTHER PUBLICATIONS

Chemical Engineering, Jun. 27, 1983, pp.14–16; Coal-Water Slurries: A Step Away from Success?

Coal:Phoenix of the '80's—Proceedings 64th CIC Coal Symposium, Ottawa '82 Preparation and Burning of Coal/Water Slurry, pp. 335–340.

Industrial Gums, 2nd ed., Roy L. Whistler, 1973, p. xi.

*Primary Examiner*—William R. Dixon, Jr.

*Assistant Examiner*—Margaret B. Medley

*Attorney, Agent, or Firm*—Gabriel Lopez; Daniel T. Szura; Hesna J. Pfeiffer

[57] ABSTRACT

An aqueous slurry containing ground coal and a biosynthetic polysaccharide is disclosed.

9 Claims, No Drawings

COAL SLURRY

BACKGROUND OF THE INVENTION

The invention is concerned with an aqueous coal slurry.

Aqueous coal slurries and their preparation and use are disclosed in the prior art (see e.g. E. P. Application No. 008,628; Bosta, N., *Chem. Eng.* 14–16, June 27, 1983; Great Britain Pat. No. 2,099,451; Proceedings 64th—CIC Coal Symposium, 335–340 (1982); U.S. Pat. Nos. 4,358,293; 4,330,301; 4,282,006; 4,441,889).

An aqueous coal slurry using a biosynthetic polysaccharide stabilizer has been developed. The slurry has improved thermal stability, i.e. retention of viscosity and stability at elevated temperatures, shear and storage properties.

SUMMARY OF THE INVENTION

An aqueous slurry containing coal additives and a biosynthetic polysaccharide.

DETAILED DESCRIPTION OF THE INVENTION

An embodiment of the invention is an aqueous slurry containing ground coal and a biosynthetic polysaccharide. The coal may be any variety such as bituminous, anthracite, sub-bituminous, lignite and the like or mixtures of varieties. The coal is comminuted using conventional equipment and procedures. The particle size of the ground coal is not critical. However, industry practice is to grind the coal to a wide particle size distribution to permit high solids loading.

The biosynthetic polysaccharide used is one prepared by aerobic fermentation of a suitable organism, a specific example being Alcaligenes microorganism ATCC 31961. One such type polysaccharide is disclosed in U.S. Pat. No. 4,401,760. Another useful polysaccharide is disclosed in U.S. application Ser. No. 692,951 filed Jan. 22, 1985. The disclosure of this application is incorporated herein by reference. It is preferred that the polysaccharide have a Brookfield LVF viscosity (No. 2 spindle, at 3 rpm), in 0.25% by weight aqueous solution of at least about 1000, and more preferably at least about 2000 cP.

The concentration of ground or particulate coal in the slurry will range up to about 80% by weight preferably from 70% to 80%. The concentration of polysaccharide in the slurry will range from about 0.01 to about 0.10% by weight and preferably from about 0.02 to about 0.05% by weight. In addition to the polysaccharide stabilizer, the slurry may also contain other additives conventionally used in preparing aqueous coal slurries such as defoamers, dispersants, salt, smoke suppressants and the like.

One feature of the polysaccharide is that it is a more efficient stabilizer than known stabilizers such as starches, xanthan gum, water soluble polymers e.g. polyethyleneoxides, polyacrylamides, etc.—and, less of the polysaccharide is required to prepare a suitable slurry, specially at high coal loadings e.g. 60% by weight and higher.

Another feature of the present slurry is that it has improved properties at elevated temperatures. The present slurry will retain its viscosity and maintain dispersion of the particulate coal even at elevated temperatures i.e. at temperatures of 60° C. to 100° C. Unlike slurries prepared using prior art stabilizers e.g. xanthan gum, water soluble polymers and the like, the present slurry will not deteriorate i.e. separate or "thin out" excessively when exposed to or held at elevated temperatures. Thus, the present slurry can be used to advantage where it may become exposed to elevated temperatures e.g. when fed as a fuel to a furnace. The slurry also offers the possibility of being preheated before being fed as a furnace fuel.

Another feature of the present slurry is that it has a high viscosity at a low shear rate. Consequently, it has good storage properties and good pumpability.

Following are formulation and rheological data for coal slurries including those of the present invention. All percentages are by weight unless otherwise indicated.

General Slurry Preparation and Evaluation Procedures

Water, dispersants and defoamer were mixed in a stainless steel container. The fine coal powder was then slowly added and mixed, then the coarse coal powder was added and mixed thoroughly. This mixture was then sheared on an Arde-Barinco mixer Model C7526 for 20 minutes at 60% power. The batch was then cooled to ambient temperature and the % solids were measured and corrected for water loss during the dispersing phase. This procedure produces the base slurry used for evaluations. Suspending agents were post-added to the base slurry and mixed until dissolved.

EXAMPLE 1

Evaluation of Formulation A—Base Slurry

Using the following base slurry formulation, A, KELZAN (a xanthan gum) and the biosynthetic polysaccharides S-194 and S-130 were evaluated at 100, 200 and 300 ppm for viscosity properties and suspension stability.

| FORMULATION A - BASE SLURRY: | |
|---|---|
| 34.0% | Tap or deionized (DI) water |
| 0.7% | Tamol SN dispersant |
| 0.2% | AMP-95 dispersant |
| 0.01% | Nalco 7SJ136 defoamer |
| 0.09% | Tap or DI water or suspending agent to q.s. 100 |
| 32.5% | Through 150 mesh fine coal |
| 32.5% | Through 60 mesh on 150 mesh coarse coal |
| 100.0% | Total |

Using the base slurry formulation A, the data in the following table were obtained:

TABLE A

| | | Viscosity* vs. Shear Rate For Example 1 Slurries | | | | | |
|---|---|---|---|---|---|---|---|
| Stabilizer | Stabilizer Level (ppm) | 5.1 $sec^{-1}$ (cP) | 10.2 $sec^{-1}$ (cP) | 170 $sec^{-1}$ (cP) | 510 $sec^{-1}$ (cP) | 1020 $sec^{-1}$ (cP) | 30 days Settling |
| None | — | 300 | 300 | 300 | 270 | 265 | Hard |
| KELZAN[1] | 100 | 1000 | 1000 | 420 | 380 | 380 | Hard |
| S-194[3] | 100 | 1000 | 750 | 510 | 450 | 430 | Hard |

TABLE A-continued

| Stabilizer | Stabilizer Level (ppm) | Viscosity* vs. Shear Rate For Example 1 Slurries 5.1 $sec^{-1}$ (cP) | 10.2 $sec^{-1}$ (cP) | 170 $sec^{-1}$ (cP) | 510 $sec^{-1}$ (cP) | 1020 $sec^{-1}$ (cP) | 30 days Settling |
|---|---|---|---|---|---|---|---|
| S-130[2] | 100 | 1000 | 750 | 510 | 460 | 440 | Hard |
| KELZAN | 200 | 1000 | 1000 | 600 | 480 | 465 | Soft |
| S-194[3] | 200 | 1500 | 1250 | 720 | 560 | 530 | None |
| S-130 | 200 | 1500 | 1000 | 600 | 500 | 475 | Soft |
| KELZAN | 300 | 1500 | 1250 | 750 | 550 | 515 | Slight |
| S-194[3] | 300 | 2000 | 1500 | 930 | 650 | 585 | None |
| S-130 | 300 | 2000 | 1500 | 750 | 600 | 545 | None |

[1]A commercial xanthan gum.
[2]A synthetic polysaccharide disclosed in U.S. 4,342,866.
[3]This is a synthetic polysaccharide, prepared by fermentation of an Alcaligenes microorganism (see U.S. 4,401,760), 0.25% by weight which dissolved in standard tap water produced a viscosity of about 2000 cP when measured on a Brookfield LVT viscometer, spindel #2 at 3 RPM.
*FANN 35 No. 10 Spring
No rheological changes occurred over the 30-day storage period.

These data showed that in a 65% coal slurry formula at 100 ppm S-194 and S-130 are substantially equal in suspension properties; at 200 ppm S-194 is superior to S-130. At 300 ppm S-130 and S-194 gums are equivalent in suspension properties. At 200 ppm, S-194 was equivalent to KELZAN and S-130 at 300 ppm.

EXAMPLE 2

Evaluation of Formulation B—Base Slurry

KELZAN and S-194 were evaluated at 100 ppm and 200 ppm. Data follows in a 70% coal slurry having the following composition.

FORMULATION B—BASE SLURRY

Formulation B is similar in composition to formulation A except that it contained about 35% fine coal, about 35% coarse coal, about 29% water, and about 1% total additives.

Using base slurry formulation B, the data in the following table were obtained.

TABLE B

| Stabilizer | Stabilizer Level (ppm) | Viscosity* vs. Shear Rate For Example 2 Slurries 5.1 $sec^{-1}$ (cP) | 10.2 $sec^{-1}$ (cP) | 170 $sec^{-1}$ (cP) | 510 $sec^{-1}$ (cP) | 1020 $sec^{-1}$ (cP) | 30 days Settling |
|---|---|---|---|---|---|---|---|
| None | — | 1000 | 1000 | 630 | 640 | 640 | Hard |
| KELZAN[1] | 100 | 1500 | 1250 | 800 | 690 | 690 | Hard |
| S-194[3] | 100 | 2000 | 1500 | 900 | 760 | 710 | Soft |
| KELZAN | 200 | 3000 | 2000 | 900 | 840 | 750 | Slight |
| S-194[3] | 200 | 4500 | 3400 | 1500 | 1100 | — | None |

*FANN 35 No. 10 Spring.
[1]A commercial xanthan gum.
[3]Defined in Table A.
No rheological changes occurred over the 30-day storage.

These data show that in this 70% coal slurry, S-194 is about twice as efficient in suspension properties as KELZAN.

EXAMPLE 3

A test method for evaluating dynamic storage or transport conditions was developed. This test uses the Roto-Tap Shaker at a very slow speed to induce a small amount of shear stress into the slurry. Two tests were run on each sample. The first was an unsheared test in which the sample was stored 24 hours under static conditions prior to testing on the Roto-Tap and second was a shear test in which the sample was mixed 10 minutes then immediately tested on the Roto-Tap.

| Stabilizer | Stabilizer Level ppm | Static 60 Days | Roto Tap 90 Min. Unsheared | Roto Tap 90 Min. Sheared |
|---|---|---|---|---|
| KELZAN[1] | 300 | Slight | 1 mm | 1 mm |
| S-194[3] | 200 | None | 1 mm | 1 mm |

[1]A commercial xanthan gum.
[3]Defined in Table A.

300 ppm KELZAN is required to stabilize this standardized 65% coal (1% additives) slurry. Lower concentrations show unsatisfactory stability under both static and dynamic conditions.

60 Days static storage tests on S-130 shows that 300 ppm use level is required. This is equivalent to KELZAN use level.

200 ppm S-194 is required to stabilize the 65% slurry vs. 300 ppm KELZAN. Lower concentrations show unsatisfactory stability under both static and dynamic conditions.

It is preferred in preparing the coal slurries to add the suspending agent or stabilizer i.e. polysaccharide, etc., to the slurry after all the other ingredients have been blended or ground together. The following example illustrates stabilizer addition during and after the grind phase.

EXAMPLE 4

Evaluation of Formulation C—Base Slurry

Formulation C has the following composition.

FORMULATION C—BASE SLURRY 30.12% water
1.88% Lomar A-23 dispersant 68.00% coal (ranging in particle size from −50 mesh to −200 mesh)

Stabilizers were added at levels of 250 ppm and 500 ppm by weight, during the grind phase and also post-added after grinding which is the most efficient and preferred order of addition.

The various slurries using base slurry, formulation C were tested for temperature stability (storage at 160° F. overnight) and shear viscosity. The data obtained are tabulated below:

TABLE C

Coal Slurry Formulation C
Stabilizer Added to the Grind
(Fann Viscosity - Fann 35 No. 10 Spring)

| Stabilizer | Lot | ppm | Overnight Storage Temp. | 3 rpm | 6 rpm | 30 rpm | 60 rpm | 100 rpm | 300 rpm | 600 rpm | % Solids |
|---|---|---|---|---|---|---|---|---|---|---|---|
| S-194 Broth | | 500 | Amb. | 2600 | 1800 | 1320 | 700 | 580 | 480 | 420 | 68.7 |
| (Fermentate) | | 500 | 160 | 3600 | 2000 | 800 | 600 | 550 | 460 | 390 | " |
| (1.4% gum) | | 250 | Amb. | 1000 | 700 | 420 | 350 | 320 | 300 | 280 | 68.3 |
| | | 250 | 160 | 1400 | 1000 | 450 | 360 | 310 | 290 | 270 | " |
| S-194[3] | 77041 | 500 | Amb. | 2000 | 1500 | 1000 | 610 | 550 | 420 | 370 | 68.4 |
| | | 500 | 160 | 2000 | 1400 | 750 | 510 | 450 | 380 | 320 | " |
| | | 250 | Amb. | 1000 | 700 | 550 | 370 | 330 | 290 | 280 | 68.1 |
| | | 250 | 160 | 1600 | 1200 | 650 | 500 | 390 | 310 | 290 | " |
| S-194[3] | 89049 | 500 | Amb. | 2000 | 1500 | 960 | 600 | 500 | 400 | 345 | 68.3 |
| | | 500 | 160 | 1800 | 1200 | 700 | 500 | 420 | 360 | 300 | " |
| | | 250 | Amb. | 1000 | 700 | 570 | 380 | 320 | 290 | 260 | 68.2 |
| | | 250 | 160 | 600 | 600 | 500 | 350 | 300 | 280 | 250 | " |
| S-194[3] | 88045 | 500 | Amb. | 1800 | 1300 | 930 | 550 | 440 | 390 | 325 | 68.4 |
| | | 500 | 160 | 1400 | 1200 | 900 | 500 | 420 | 390 | 310 | " |
| | | 250 | Amb. | 800 | 700 | 510 | 350 | 300 | 270 | 250 | 68.3 |
| | | 250 | 160 | 800 | 600 | 500 | 340 | 310 | 280 | 250 | " |
| KELZAN | 82014 | 500 | Amb. | 1600 | 1200 | 870 | 590 | 430 | 390 | 315 | 68.4 |
| | | 500 | 160 | 1000 | 800 | 510 | 370 | 330 | 290 | 270 | " |
| | | 250 | Amb. | 600 | 500 | 480 | 310 | 290 | 260 | 245 | 68.5 |
| | | 250 | 160 | | | | hard pack | | | | |
| | | | | 5.1 | 10.2 | 51 | 102 | 170 | 510 | 1020 | |
| | | | | | | | Shear Rate ($sec^{-1}$) | | | | |

[3]Defined in Table A.

TABLE D

Coal Slurry Formulation B Rheology
Stabilizer Post Added to the Grind
(Fann Viscosity - Fann 35 No. 10 spring)

| Stabilizer | Lot | Amt. ppm | Storage Temp. | 3 rpm | 6 rpm | 30 rpm | 60 rpm | 100 rpm | 300 rpm | 600 rpm | 68.8% |
|---|---|---|---|---|---|---|---|---|---|---|---|
| KELZAN | 82014 | 500 | Amb. | 2000 | 1700 | 1150 | 650 | 500 | 440 | 370 | |
| | | 500 | 160 | 1100 | 900 | 550 | 380 | 350 | 310 | 300 | |
| | | 250 | Amb. | 1000 | 800 | 630 | 430 | 380 | 310 | 250 | |
| | | 250 | 160 | | | | hard pack | | | | |
| S-194[3] | 77041 | 500 | Amb. | 3200 | 2200 | 1400 | 900 | 650 | 510 | 450 | |
| | | 500 | 160 | 4000 | 2800 | 1600 | 1100 | 750 | 560 | 480 | |
| | | 250 | Amb. | 1600 | 1200 | 800 | 490 | 400 | 340 | 300 | |
| | | 250 | 160 | 2000 | 1200 | 750 | 450 | 380 | 330 | 290 | |
| S-194[3] | 88045 | 500 | Amb. | 4200 | 2800 | 1800 | 970 | 820 | 670 | 560 | |
| | | 500 | 160 | 5200 | 3800 | 2000 | 1000 | 850 | 710 | 600 | |
| | | 250 | Amb. | 3400 | 2500 | 1500 | 750 | 630 | 550 | 470 | |
| | | 250 | 160 | 4200 | 3400 | 1700 | 850 | 700 | 670 | 550 | |
| S-194[3] | 89049 | 500 | Amb. | 3000 | 2100 | 1300 | 860 | 710 | 500 | 440 | |
| | | 500 | 160 | 4000 | 2800 | 1250 | 900 | 700 | 610 | 530 | |
| | | 250 | Amb. | 2000 | 1300 | 950 | 520 | 470 | 390 | 330 | |
| | | 250 | 160 | 600 | 500 | 390 | 350 | 320 | 280 | 270 | |
| | | | | 5.1 | 10.2 | 51 | 102 | 170 | 510 | 1020 | |
| | | | | | | | Shear Rate ($sec^{-1}$) | | | | |

[3]Defined in Table A.

As the data in these tables indicates, xanthan gum slurries lost viscosity and permitted sedimentation when 250 ppm of the gum was used; the slurries stabilized with 250 ppm of S-194 (a synthetic polysaccharide) were stable. As pointed out earlier, this temperature stability is an advantage for general tank storage as well as for slurries which are pre-heated before injection as a fuel into a furnace.

EXAMPLE 5

Using the base slurry, formulation C, rheological data for Kelzan M and S-194 (two viscosities) were obtained at ambient temperature and 160° F. The data are tabulated below:

TABLE E

| Stabilizer | lot | ppm | Temp. | Stabilizer Added After Grind Fann 35 Viscosity (cP) 3 rpm | 6 rpm | 30 rpm | 60 rpm | 100 rpm | 300 rpm | 600 rpm |
|---|---|---|---|---|---|---|---|---|---|---|
| Kelzan M | 82014 | 500 | Amb. | 1800 | 1400 | 950 | 760 | 520 | 400 | 360 |
| | | 500 | 160° F. | 1000 | 800 | 500 | 360 | 340 | 300 | 290 |
| S-194[a] | 77041 | 250 | Amb. | 1700 | 1300 | 750 | 480 | 390 | 330 | 300 |
| | | 250 | 160° F. | 1900 | 1300 | 750 | 450 | 380 | 320 | 300 |
| | | 350 | Amb. | 2600 | 1900 | 1200 | 750 | 510 | 420 | 380 |
| | | 350 | 160° F. | 3000 | 2000 | 1300 | 850 | 520 | 420 | 380 |
| S-194[b] | 92057 | 250 | Amb. | 3300 | 2100 | 1300 | 800 | 630 | 500 | 440 |
| | | 250 | 160° F. | 4200 | 3400 | 1700 | 850 | 650 | 510 | 450 |
| | | 350 | Amb. | 4200 | 2800 | 1800 | 970 | 820 | 650 | 550 |
| | | 350 | 160° F. | 5000 | 3600 | 1800 | 900 | 810 | 620 | 520 |

[a]Brookfield viscosity about 2000 cP; see Table A definition.
[b]Brookfield viscosity about 2500 cP; see Table A definition.

The data show that both S-194[a] and S-194[b] are more efficient stabilizers than xanthan gum for increasing the low shear rate viscosities of coal slurries which increases the stability and prevents sedimentation. Both types are more stable at elevated temperatures than xanthan gum. The higher viscosity S-194[b] is also much more efficient than the standard S-194[a] grade.

The S-194[b] preparation is described in said U.S. patent application filed even day herewith now Ser. No. 692,951.

Following are examples of the preparation of S-194 type polysaccharides which are the preferred suspending agents in the present slurries. Example 7 polysaccharides having a 0.25% aqueous solution viscosity of over 2000 are more preferred.

EXAMPLE 6

The fermentation procedure described in U.S. Pat. No. 4,401,760 was used to prepare polysaccharide S-194. The fermentation medium used was that, substantially set out below, and disclosed in U.S. Pat. No. 4,401,760, column 5, lines 10–17.

Fermentation Medium A

Tap water
3.0% Glucose
0.05% $K_2HPO_4$
0.20% PROMOSOY 100
0.01% $MgSO_4.7H_2O$
0.09% $NH_4NO_3$
0.01–0.05% Antifoam Soy protein concentrate obtained from Central Soya.

The fermentation was carried out in commercial fermentors. Following is a tabulation of a number of fermentation batches and viscosity of the polysaccharide products in 0.25% aqueous solution, using a Brookfield viscometer Model LVT, No. 2 spindle, at 3 rpm.

| Batch | 0.25% Viscosity |
|---|---|
| 1 | 2000 |
| 2 | 1600 |
| 3 | 1900 |
| 4 | 1250 |
| 5 | 1950 |
| 6 | 340 |
| 7 | 1050 |
| 8 | 1300 |
| 9 | 1450 |
| 10* | 1500 |
| 11* | 1550 |
| Average | 1,444 |

*Corn syrup was substituted for glucose in the fermentation medium

EXAMPLE 7

S-194 type polysaccharides were prepared using substantially the same fermentation procedure as in Example 6 but substituting corn syrup for glucose, deionized (DI) water for tap water and HY SOY for PROMOSOY in fermentation medium A. HY SOY is a papain digested soybean meal extract obtained from Sheffield Products, Norwich, N.Y. Following is a tabulation of data for S-194 batches so prepared.

| Batch | 0.25% Viscosity |
|---|---|
| A | 2310 |
| B | 2210 |
| C | 2240 |
| D | 2770 |
| E | 3160 |
| F | 2600 |
| G | 2470 |
| H | 2780 |
| I | 2620 |
| J | 2150 |
| K | 1380 |
| L | 2560 |
| M | 2490 |
| N | 2790 |
| O | 2770 |
| P | 2100 |
| Average | 2,462 |

What is claimed is:

1. An aqueous slurry containing coal and a biosynthetic polysaccharide which is S-194 or S130.

2. The slurry of claim 1 wherein the coal concentration is at least about 60% by weight.

3. The slurry of claim 1 wherein the polysaccharide is S-130.

4. The slurry of claim 3 wherein the S-130 concentration is 0.01–0.10% by weight.

5. The slurry of claim 1 wherein the polysaccharide is S-194.

6. The slurry of claim 5 wherein the S-194, in 0.25% aqueous solution, has a Brookfield viscosity, using 2 spindle at 3 rpm, of at least about 2000.

7. The slurry of claim 5 wherein the S-194 concentration is 0.01–0.10% by weight.

8. The slurry of claim 5 wherein the S-194, in 0.25% aqueous solution, has a Brookfield viscosity, using 2 spindle at 3 rpm, of at least about 2500.

9. The slurry of claim 8 wherein the S-194 is prepared by aerobic fermentation of Alcaligenes species, ATCC 31961, the fermentation being characterized by use of deionized water and a hydrolyzed soybean protein in the fermentation medium.

* * * * *